United States Patent [19]

Mecham

[11] 4,034,891

[45] July 12, 1977

[54] REFILLABLE CONTAINER FOR DISPENSING PHOTOSENSITIVE ROLLED SHEET

[75] Inventor: Lorrie E. Mecham, Canyon Country, Calif.

[73] Assignee: Commercial Ventures, Ltd., Traverse City, Mich.

[21] Appl. No.: 728,313

[22] Filed: Sept. 30, 1976

[51] Int. Cl.[2] ..... B65D 43/14; B65D 51/04

[52] U.S. Cl. ..... 220/339; 220/22.1; 220/315; 229/44 R; 206/316

[58] Field of Search ..... 220/335, 337, 339, 307, 220/315, 22.1; 229/44 R; 206/316

[56] References Cited

U.S. PATENT DOCUMENTS

| | | | |
|---|---|---|---|
| 3,651,983 | 3/1972 | Haugen | 220/339 X |
| 3,737,067 | 6/1973 | Palson | 220/339 X |

*Primary Examiner*—George T. Hall

[57] ABSTRACT

A flexible plastic rectangular container for dispensing bulk rolled paper is molded with a stiffened top lid attached by an elastic hinge pre-stressed to hold the lid open. The stiffened lid has a skirt portion with latching projections to engage recesses in the container ends when the lid is closed. Manual application of a torsional couple to the container ends so distorts the container as to release the projections from the recesses, upon which the pre-stress on the hinge forces the lid open.

6 Claims, 5 Drawing Figures

REFILLABLE CONTAINER FOR DISPENSING PHOTOSENSITIVE ROLLED SHEET

BACKGROUND OF THE INVENTION

In the operation of certain phototypesetting machines light-sensitive paper is fed from a roll. Some of such phototypesetters are loaded with paper in bulk rolls. Because of the difficulty in loading in lighted areas, machines capable of accepting pre-loaded single-use paper dispensing cassettes were introduced. These cassettes substantially increase the cost of operations.

SUMMARY OF THE INVENTION

The purpose of the present invention is to replace single-use paper dispensing cassettes with a container for dispensing light-sensitive, bulk-rolled paper capable of being reloaded in a darkened room.

Summarizing generally, the container is a flexible, integrally-formed, molded plastic retangular enclosure having a top lid attached by an integral elastic hinge pre-stressed to bias the lid to open position. A skirt portion of the lid serves as a light baffle when closed and stiffens the lid. It has latching projections with sloping lead-in surfaces; these serve as cams to press against the side portions and engage recesses in the container sides, for locking the lid closed. The container body is sufficiently flexible that it may be distorted by manual application of a torsional couple to its ends. Twisting in one sense causes one of its latching projections to disengage from its recess and twisting in the opposite sense disengages the projection at the opposite end. Meantime the stiffened lid is being drawn to open position by the elastic stress on the hinge.

DESCRIPTION OF THE EMBODIMENT

Figure 1:
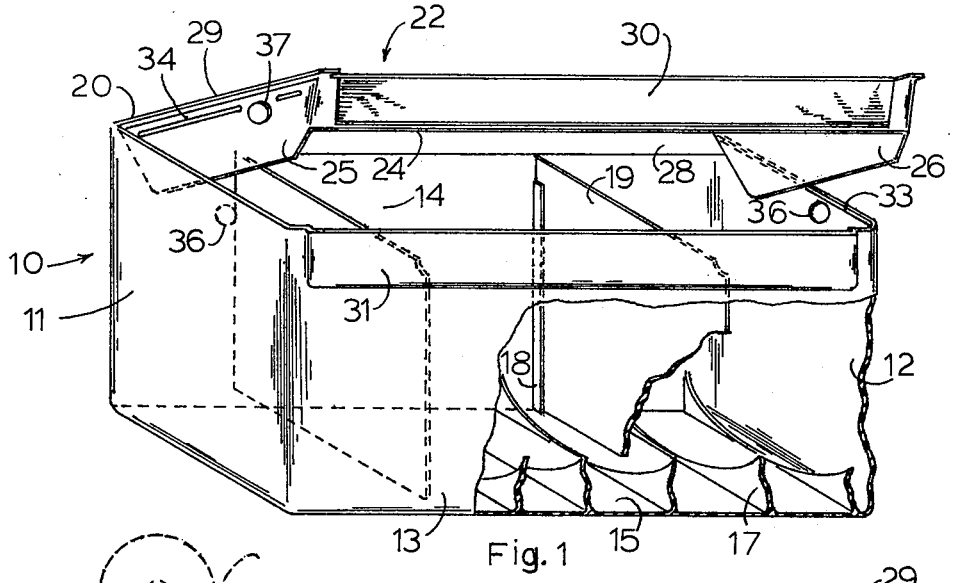
FIG. 1 is a cabinet projection view, partly broken away, showing the container of the present invention with its lid supported in open position by its integral hinge.
Figure 2:
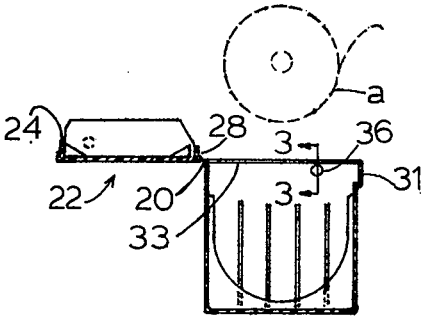
FIG. 2 is a schematic cross-sectional view taken through the container of FIG. 1 with its lid in the position as molded. The dashed lines show a roll of light-sensitive paper capable of being loaded into the container.

The container illustrated in the drawings serves essentially as a reloadable cassette for phototypesetting paper and the like. It is molded in one piece of somewhat elastic plastic material, such as polyproplene, with the lid open as shown in FIG. 2, so that when the lid is folded over as shown in FIG. 1, elastic spring-like resistance will develop in its integral hinge, to bias it from closed position to the FIG. 1 position.

The container generally designated 10, so mounted, includes left and right ends 11, 12, a forward wall 13 and a rear wall 14 joined by a bottom surface 15. In order that a roll of photosensitive paper such as the roll *a* may be cradled thereon, concave shallow ribs 17 extend along the bottom surface 15, joined to the lower portions of the front and rear walls 13, 14, but the ribs 17 are not so large as would adversely impair the required torsional elasticity of the container hereafter described. To adapt the container for various widths of paper rolls *a*, pairs of ribs 18 are provided along the front and rear walls 13, 14 to accommodate a removable panel 19.

Along the upper edge of the rear wall 14 is a integral connecting hinge 20 which is formed thinner than the walls referred to and hence more flexible. It mounts the container lid generally designated 22 which includes an upper surface 23 extending forward from the hinge 20 to a forward margin 24 which slopes inwardly, to facilitate opening and closing the lid 20 and facilitate dispensing of the roll of photosensitive sheet material *a*. The left and right ends of the forward margin 24 merge into left and right side margins 25 and 26 of somewhat greater depth. The rear ends of these are joined to a rear lid flange 28. The margins 24, 25, 26 and 28 are so continuous about the upper surface 23 as to make the lid 22 highly rigid as compared with the upper opening of the container. The margins 24, 25, 26 and 28 also serve as light baffles, as do projecting end edges 29 of the lid upper surface 23.

On the forward surface of the inward sloping flange margin 24 is adhered a pile fabric strip 30 which seals the forward edge of the container against light. The space required for it is provided by a forward-joggled edge 31 of the forward wall 13, against which the pile fabric strip 30 bears, permitting the photosensitive sheet material *a* to be drawn between them.

Figure 3:
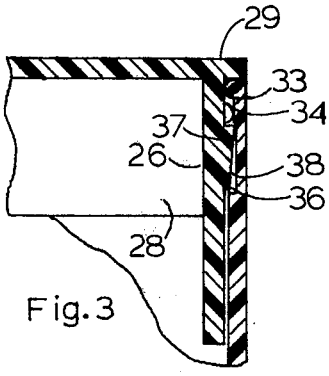
FIG. 3 is a greatly enlarged cross-sectional view taken along line 3—3 of FIG. 2, with the lid closed.

For further light sealing at the container ends, the upper edges of the container ends 11 and 12 are preferably provided with small inward projecting lips 33, which slightly overlay complementary external ribs 34 as best seen in the enlarged view in FIG. 3. To the extent of their overlay, a degree interference is provided which aids latching of the lid 20 on closing.

Immediately below the interfitting light sealing projections 33, 34, complementary detent projections are formed on the interior of the ends 11, 12 to cooperate with projections mounted on the left and right side flange margins 25 and 26. In the embodiment illustrated, simple shallow cylindrical blind bores or recesses 36 are formed near the upper edge of the ends 11, 12. Projecting from the left and right side flange margins 25, 26 are integral latching projections 37 each having upward and outward sloping lead-in surfaces 38. As the lid 22 is closed, the sloping lead-in surfaces 38 cams the end walls 11, 12 to deflect outward, until the latching projections 37 catch within the blind bores 36.

While the lid 22 is stiffened by its flanges, the body of the container 10 and particularly the opening formed by its upper edges is quite flexible. As noted, the ribs 17 are small and the panel 19 is removable, so as to avoid excessive torsional stiffness. The resulting flexibility is utilized to release the detents 37 at the left and right ends alternately, in the manner illustrated in FIGS. 4 and 5.

Figure 4:
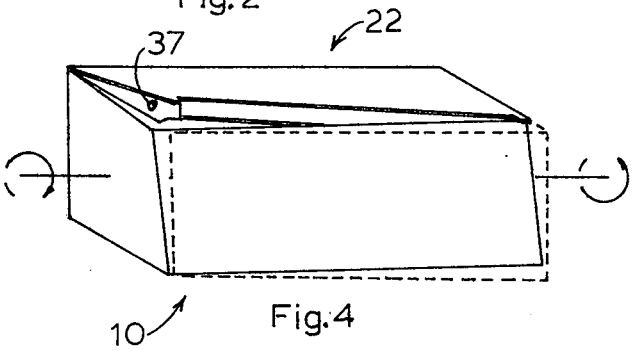
FIG. 4 is a sketch illustrating the deflection of the container as it is twisted to open the left end, with the right end still closed.

A torsional couple is applied to the left and right ends of the box 10, the user holding it in his hands and leaving the lid 22 free to open. Thus, as the forward right side is twisted upward and aft as the left is twisted forward and down, as shown in FIG. 4 the top opening of the container will so distort as to release the detent projection 37 at the left end, and also relieve any interference between the rib 34 and the lip 33 thereat. The elastic stress in the hinge 20 then lifts the left end of the lid 23.

Figure 5:
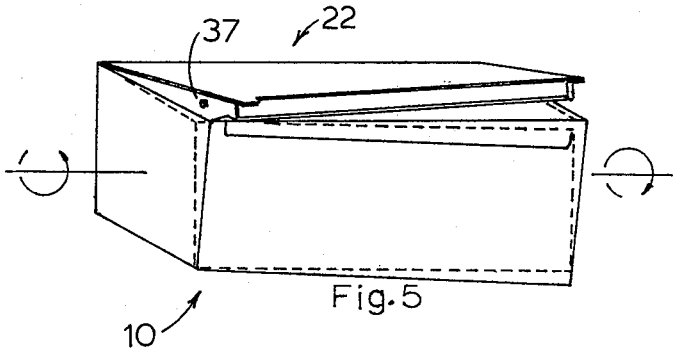
FIG. 5 is a similar sketch illustrating the deflection of the container thereafter to open the right end.

The direction of torsional stress is then reversed as shown in FIG. 5, torsionally deflecting the container, and so distorting its upper opening as to release the right end similarly. This permits the lid 22 to spring open to the position shown in FIG. 1. Obviously, the right end might have been opened prior to the left end.

The result is exceptional security from unintended opening while maintaining the simplicity of one piece construction. It is impossible to apply the reversing torsional couples accidentally, even if the container is dropped, it will not spring open. Since there are no separate latches, it may be handled in a dark room with ease and security. This results from the ease of distorting the enclosure opening relative to the stiff lid 22, which distortion shifts one or the other of the end panels 11, 12 away from the adjacent flanged skirt portion 25, 26 of the lid, to release the complementary detent means at one end of the container independently of those at the other. The elastic stress on the hinge, resulting from the molding the polypropylene material as illustrated in FIG. 2, biases the lid to open position as these detent means are released to achieve the purposes of the invention.

Variations in detail, to adapt this disclosure to modified uses and purposes, will be apparent to those skilled in the art.

I claim:

1. A container for dispensing light-sensitive rolled sheet comprising an integrally-formed molded plastic rectangular enclosure of such proportions as to be flexible under a manually applied torsional couple and having a bottom panel, front and rear side panels, a pair of opposed end panels, a top lid, further having an integral elastic hinge mounting said lid to said rear side panel, whereby to permit movement of said lid between an open and a closed position, said container being so molded with its lid open that on closing said hinge is elastically stressed, said lid having side margins extending over the adjacent edges of said end panels and further having a light-baffling stiffening skirt portion extending inwardly of said enclosure adjacent the inner surfaces of said side and end panels, and complementary detent means formed on the interior of each of said end panel and the exterior of those skirt portions inwardly adjacent thereto when the lid is closed, whereby manual application of a torsional couple about an axis parallel to said hinge so distorts the enclosure opening, relative to said stiffened lid, as to shift one or the other of said end panels away from the adjacent skirt portion of said lid, thereby releasing its complementary detent means there present, the elastic-stress in said hinge then drawing the lid open at said end panel.

2. A container as defined in claim 1, wherein said enclosure is formed of polypropylene.

3. A container as defined in claim 1, wherein said front and rear side panels include a plurality of vertical guide means for receiving vertical portion panels, whereby to avoid stiffening said enclosure and permitting it to retain its torsional flexibility.

4. A container as defined in claim 1, wherein said complementary detent means comprises an integral latching projection having a sloping lead-in surface, and recess means to engage said latching projection in closing said lid.

5. A container as defined in claim 1, wherein said detent means further includes rib means formed on the exterior of those skirt portions adjacent to said end panels, and lip means formed on the interior of said end panels and so positioned thereon as to overlap said rib means when the lid is closed, whereby said rib means and overlapped lip means together function both to augment such latching and to block entrance of light.

6. A container as defined in claim 1, wherein said light-baffling skirt portion slants inwardly awway from said front panel when said lid is closed, whereby to permit easy opening and closing of said lid and to facilitate smooth dispensing of such rolled sheet material.

* * * * *